US010271637B2

(12) United States Patent
Cannon

(10) Patent No.: US 10,271,637 B2
(45) Date of Patent: Apr. 30, 2019

(54) PAINT PUCK

(71) Applicant: Dawson Cannon, Dublin, CA (US)

(72) Inventor: Dawson Cannon, Dublin, CA (US)

( * ) Notice: Subject to any disclaimer, the term of this patent is extended or adjusted under 35 U.S.C. 154(b) by 0 days.

(21) Appl. No.: 15/499,827

(22) Filed: Apr. 27, 2017

(65) Prior Publication Data

US 2018/0249817 A1 Sep. 6, 2018

Related U.S. Application Data

(60) Provisional application No. 62/466,927, filed on Mar. 3, 2017.

(51) Int. Cl.

| | |
|---|---|
| ***A46B 17/06*** | (2006.01) |
| ***B08B 1/00*** | (2006.01) |
| ***B08B 3/04*** | (2006.01) |
| ***B44D 3/00*** | (2006.01) |

(52) U.S. Cl.

CPC ..... *A46B 17/06* (2013.01); *B08B 1/00* (2013.01); *B08B 3/04* (2013.01); *B44D 3/006* (2013.01); *A46B 2200/205* (2013.01)

(58) Field of Classification Search

CPC .. A46B 17/06; B08B 1/00; B08B 3/04; B44D 3/06

See application file for complete search history.

(56) References Cited

U.S. PATENT DOCUMENTS

| | | | | |
|---|---|---|---|---|
| 9,826,824 | B2 * | 11/2017 | Lim | A46B 17/06 |
| 9,867,457 | B2 * | 1/2018 | Albers | A46B 17/06 |
| 2015/0013726 | A1 * | 1/2015 | Webster | A46B 17/06 134/34 |

* cited by examiner

*Primary Examiner* — Shay Karls

(74) *Attorney, Agent, or Firm* — Kelsey Stout Intellectual Property

(57) ABSTRACT

A circular paint "puck" is molded silicone or rubber with a diameter matching the bottom of a standard coffee cup or else a standard disposable paint mixing cup of 8 oz, 16 oz, 32 oz or 64 oz. The puck is a disk featuring cleaning surfaces on the top side and, on the bottom, suction cups for securing the puck to the bottom of the cup and preventing its moving during brush cleaning. A painter using the puck attaches it to the bottom of the brush-washing cup, fills the cup with water, and agitates paint brushes against the cleaning surfaces to clean them. The paint puck is made of flexible silicone rubber for economy, molding specialized surfaces, easy cleaning and easy removal from the cup. However, the silicone must have enough rigidity to provide a functional suction cup and for its cleaning surfaces to provide resistance to sticky, wet brush bristles covered in paint.

16 Claims, 6 Drawing Sheets

PAINT PUCK

CLAIM OF PRIORITY BENEFIT

This application claims the benefit of USPTO Provisional Application No. 62/466,927, filed 3 Mar. 2017.

FIELD OF THE INVENTION

The invention relates a device used for cleaning a paint brush in a standard sized cup.

BACKGROUND INFORMATION

Artists and detail painters use cups of water to wash the paint from their brushes when switching paint colors. Cups typically chosen for this purpose include standard-sized coffee cups and disposable paint mixing cups in 8 oz, 16 oz, 32 oz and 64 oz sizes.

Painters will have trouble attempting to wash and scrape paint from brush bristles and brush stems using the smooth inner surfaces of the cups. The invention provides surfaces useful inside a standardized cup for cleaning paint from brushes. The invention is stable while in agitated water, inexpensive and easy to clean.

Paint Puck Specifications

A circular paint "puck" is molded of silicone or rubber with a diameter matching the bottom of a standard coffee cup or else a standard disposable paint mixing cup of 8 oz, 16 oz, 32 oz or 64 oz. The puck is a disk featuring cleaning surfaces on the top side and, on the bottom, suction cups for securing the puck to the bottom of the cup and preventing its moving during brush cleaning. A painter using the puck attaches it to the bottom of the brush-washing cup, fills the cup with water, and agitates paint brushes against the cleaning surfaces to clean them.

The paint puck is made of flexible silicone rubber to allow economy, molding of specialized cleaning surfaces, easy cleaning and easy removal from the cup. However, the silicone must have enough rigidity to provide a functional suction cup and for its cleaning surfaces to provide resistance to sticky, wet brush bristles covered in paint. Thus, the paint puck must have a minimum Shore (A) hardness of 15 and a maximum Shore (A) hardness of 70. The preferred embodiment. Lower hardnesses may require an externally attached suction cup, so a minimum Shore (A) hardness of 25 is preferred when using a single-piece mold including a suction cup and for at least "good" durability. Higher hardnesses are good for brush cleaning surfaces, but may cause difficulty in removal from the bottom of a cup full of paint and water, so a maximum Shore (A) hardness of 55 is indicated in the preferred embodiment.

When manufactured with an integral suction cup, the paint puck uses at least four molds. When manufactured with a separated, attachable suction cup, the paint puck can be made with only two molds. The suction cup sits as flush as possible to the bottom of the middle disk of the paint puck, adding no more than 7 mm to its height, in order to leave room inside the washing cup.

Paint Cleaning Teeth

The cleaning surfaces on the upper surface of the paint puck are arranged as three concentric sets of "teeth" arranged to provide brush cleaning surfaces when the brush is agitated in either radial or circular motion. Each concentric ring of teeth is stepped in height so that the two inner rings of teeth present outside surfaces standing higher than the previous, more outside ring of teeth. Radial motion toward the center of the puck scrapes the brush against the outside of each ring.

Within each of the three rings, the teeth are varied in height and stand separate, so that circular motion of a brush in the cleaning cup scrapes the brush bristles against the edges and points of the teeth.

The innermost ring of teeth comprises a central "beak", which is the tallest and most massive tooth. The mass of the beak provides enough rigidity to divide, scrape and clean large paintbrushes with heavy bristles. The largest tooth is placed in the center of the paint puck so that a large brush placed into the washing cup without care will strike the beak.

To prevent a paintbrush placed in the washing cup from tipping over when rested on the beak, the beak should be no taller than 50 mm. To clean a large brush, the beak should be no shorter than 20 mm. In the preferred embodiment, the beak height can be set at between 20% to 30% of the washing cup depth. The next ring of teeth can be set at ⅔ the height of the beak, and the outer ring of teeth at ⅓ the height of the beak, with the smaller teeth at least 7 mm tall.

The middle disk of the paint puck to which the teeth and suction cup attach is at least 5 mm thick. To prevent the paint puck folding back on itself in the water of the washing cup during agitation and washing, the middle disk plus smallest teeth must, when the disk is doubled back on itself, have a total thickness equal to at least ⅙ the diameter of the paint puck.

Other methods and structures are described in the detailed description below. This summary does not purport to define the invention. The invention is defined by the claims.

DETAILED DESCRIPTION

Figure 1:
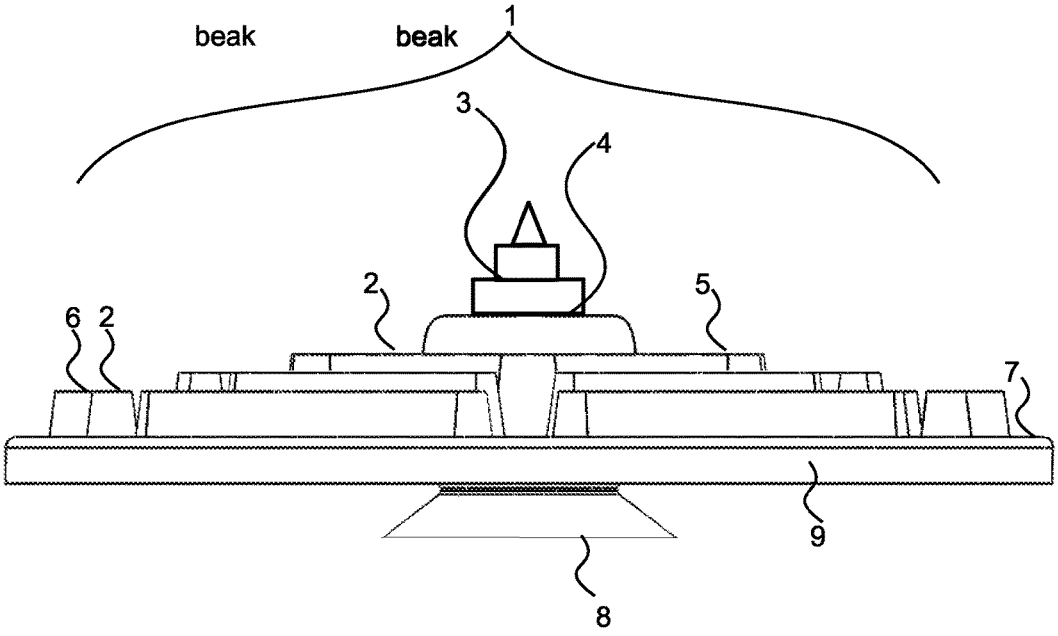
FIG. 1 is a perspective view of an embodiment of the paint puck featuring spike-shaped teeth. The beak, $2^{nd}$ ring of teeth and $3^{rd}$ ring of teeth are shown affixed to the top of the disk. The suction cup is affixed to the bottom of the disk.

FIG. 1 is a side view of an embodiment of the paint puck 1 featuring teeth 2 and a spike-shaped beak 3. Paint puck material must allow a Shore (A) hardness of between 15 and 70 and must allow enough flexibility to remove a wet, slippery paint puck from within a washing cup into which it may be tightly fitted. Paint puck material is, preferably, chemically inert or resistant to painting materials and cleansers. Paint puck material is also relatively inexpensive to use in injection molding. Therefore, paint puck material is, in the preferred embodiment, silicone rubber, but may be any rubber, plastic or elastomere which meets these requirements.

The first set 4 of teeth including a beak 3, second plurality 5 of teeth and third plurality 6 of teeth are shown affixed to the top of the staging disk 7. The suction cup 8 is affixed to the bottom of the staging disk. A staging disk outside edge 9 shows the thickness of the staging disk.

Teeth are, for the purposes of this application, portions of paint puck material protruded upward from the upper surface of the staging disk and having vertical surfaces against which paint brush bristles may be brushed in order to scrape paint from the bristles or disperse the paint into a solvent. The beak 3 is considered a type of tooth here. Teeth may take the shape of, for example, rectangular towers, cylindrical towers, spikes, a series of connected or detached walls, concentric circles, or fanciful shapes.

Figure 2:
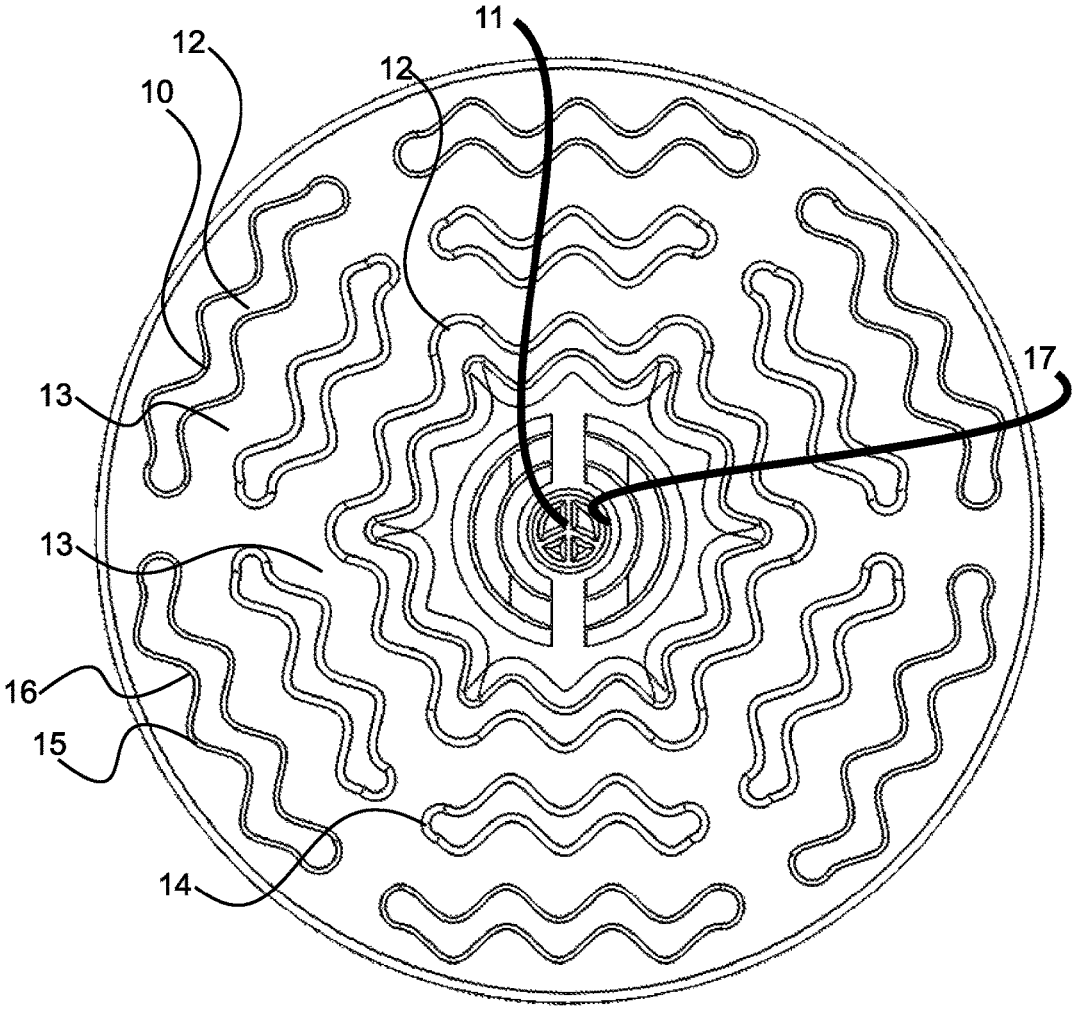
FIG. 2 is a side view of an embodiment of the paint puck featuring ledge-shaped teeth and a spike-shaped beak. The beak, $2^{nd}$ ring of teeth and $3^{rd}$ ring of teeth are shown affixed to the top of the disk. The suction cup is affixed to the bottom of the disk.

FIG. 2 is a top view of the paint puck of FIG. 1 featuring ledge-shaped 10 teeth and a spike-shaped beak 11. The beak, in this example comprising the entirety of the first set 4 of teeth, second set 5 of teeth and third set 6 of teeth are shown affixed to the top of the staging disk 7. In the preferred embodiment, the first, second and third set of teeth are arranged concentrically as shown here.

The ledge-shaped teeth and the spaces between them are considered lands 12 and grooves 13 making up a lands-and-grooves pattern of teeth as shown here. An indicated tooth end 14 and tooth outside corner 15 are examples of circular paint-cleaning barriers. Circular paint-cleaning barriers are vertical edges of teeth against which paintbrush bristles scrape when a paintbrush is brushed in a circular motion across the upper surface of the paint puck.

An indicated tooth inside corner 16 and beak edge 17 are examples of radial paint-cleaning barriers. Radial paint-cleaning barriers are vertical edges of teeth against which paintbrush bristles scrape when a paintbrush is brushed in a radial motion across the upper surface of the paint puck, from center to edge or from edge to center.

Figure 3:
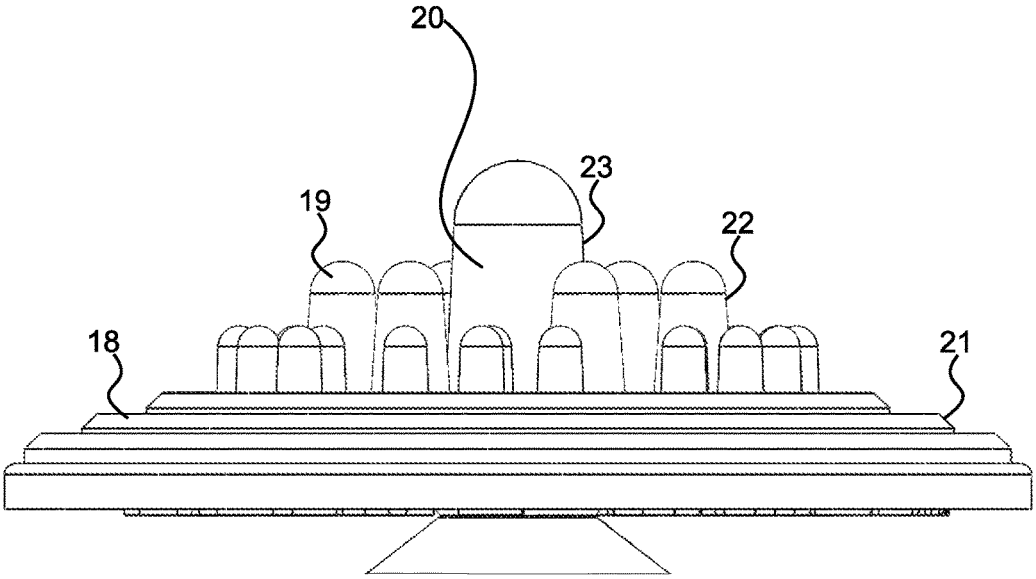
FIG. 3 is a top view of an embodiment of the paint puck featuring ledge-shaped teeth and a spike-shaped beak. The beak, $2^{nd}$ ring of teeth and $3^{rd}$ ring of teeth are shown affixed to the top of the disk.

FIG. 3 is a side view of an embodiment of the paint puck featuring concentric circular teeth 18 cylindrical teeth 19 and a cylindrical beak 20. The first set 4 of teeth, second set 5 of teeth and third set 6 of teeth are shown affixed to the top of the staging disk. The suction cup 8 is affixed to the bottom of the disk.

A vertical edge of a concentric circular tooth 21, a vertical edge of a cylindrical tooth 22 and a vertical edge of a beak 23 indicated are examples of radial paint-cleaning barriers. While the teeth making the radial paint-cleaning barriers can have Shore (A) durometer of as low as 15, it is preferred that the teeth provide a stronger resistance to heavy, wet, paint-coated bristles in the preferred embodiment of the paint puck. Teeth that provide a stiffer radial paint-cleaning barrier by having a Shore (A) durometer of at least 25 are referred to, for the purposes of this application, as having an aggressive radial barrier commitment.

The side view here also allows us to introduce another key feature of paint puck that will be discussed further in FIG. 6. It will be seen that the paint puck must be constituted such that it will not fold over on itself during use. This resistance to remaining at rest such that the staging disk is folded is referred to for the purposes of this application as a plane reversion commitment. The plane reversion commitment may also be thought of as a tendency for the staging disk to return to a flat plane shape after being flexed or folded. A paint puck device of between 15 and 70 Shore (A) durometer will have plane reversion commitment by having a staging disk thickness and height of shortest tooth that, added together, are larger the one-twelfth the diameter of the staging disk.

Figure 4:
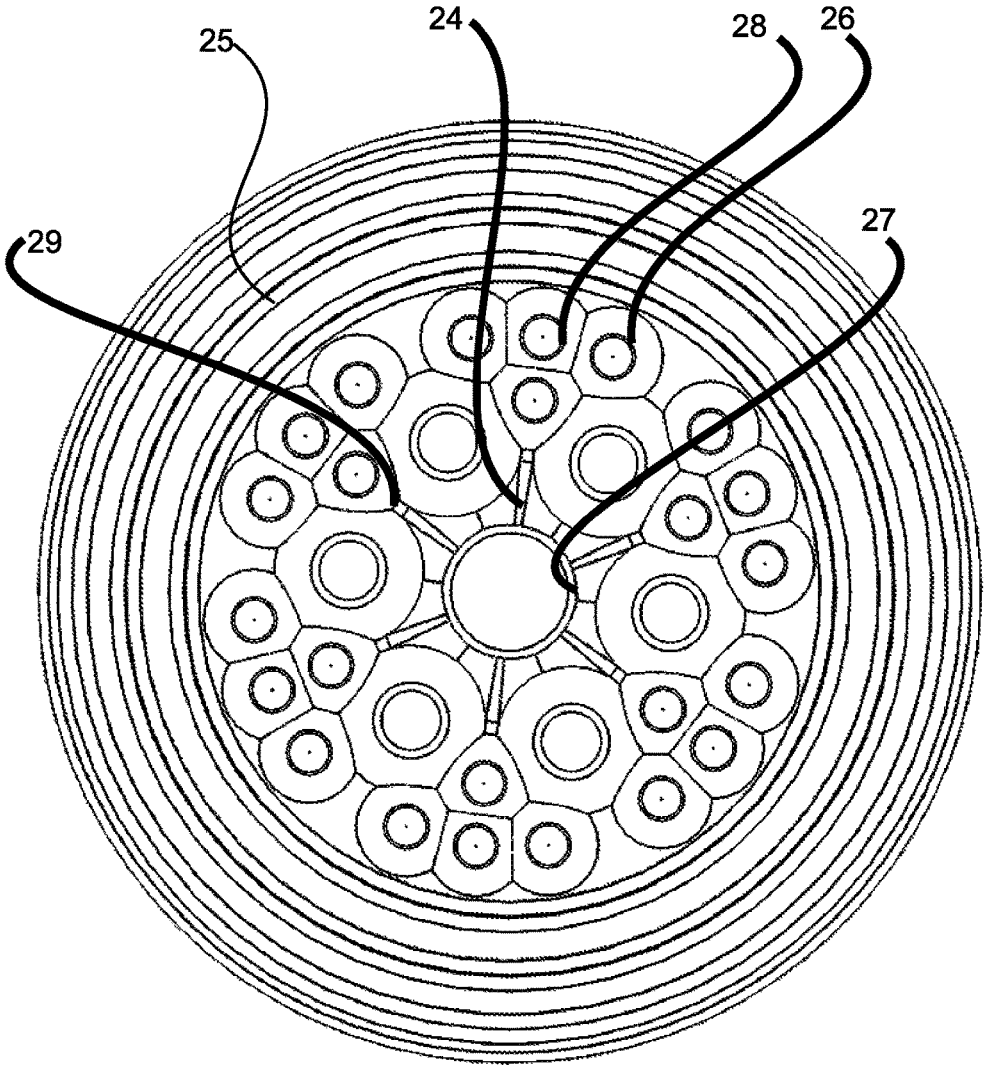
FIG. 4 is a top view of an embodiment of the paint puck featuring concentric sets of teeth.

FIG. 4 is a top view of an embodiment of the paint puck featuring concentric circular third set of teeth 18, cylindrical second concentric set of teeth 19 and a first central set of teeth featuring cylindrical beak 20 and ledge-shaped teeth 24 radiating outward from the beak.

The concentric circular third set of teeth 18 describe a lands-and-grooves tooth pattern and act as radial paint-cleaning barriers 25. The outside vertical edge of a cylindrical tooth 26 and vertical edge of the beak 27 also provide radial paint-cleaning barriers.

The lateral vertical edge of a cylindrical tooth 28 and a vertical edge of a ledge-shaped tooth 29 provide circular paint-cleaning barriers.

The thin, free-standing vertical teeth of the second set of teeth 19 describe a spiky teeth pattern, whether the tooth shapes are spiky, cylindrical or rectangular.

Figure 5:
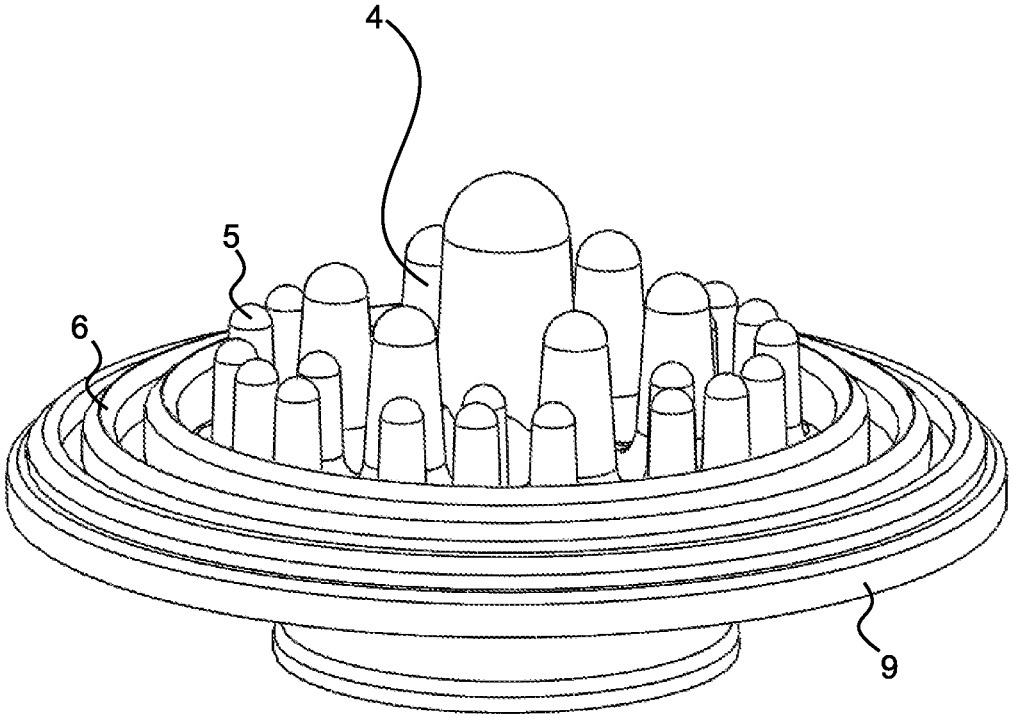
FIG. 5 is a perspective view of the paint puck of FIG. 3 and FIG. 4.

FIG. 5 is a perspective view of the paint puck of FIG. 3 and FIG. 4. The first set 4 of teeth, second set 5 of teeth and third set 6 of teeth are shown affixed to the top of the staging disk. The suction cup 8 is affixed to the bottom of the disk.

The staging disk edge 9 indicated will show that the staging disk is, to contribute to the plane reversion commitment, at least 5 mm thick in the preferred embodiment. The minimum tooth-height for the beak 3 is at least 8 mm in order that the beak will scrape paint from long brush bristles. Also, to provide useful paint-scraping surfaces, the maximum tooth-height for the teeth in the third, outer set of teeth is 5 mm less than the minimum tooth-height for the teeth in the second set of teeth in the preferred embodiment. Similarly, the maximum tooth-height for the teeth in the second set of teeth is 5 mm less than the minimum tooth-height for the first set of teeth in the preferred embodiment.

Figure 6:
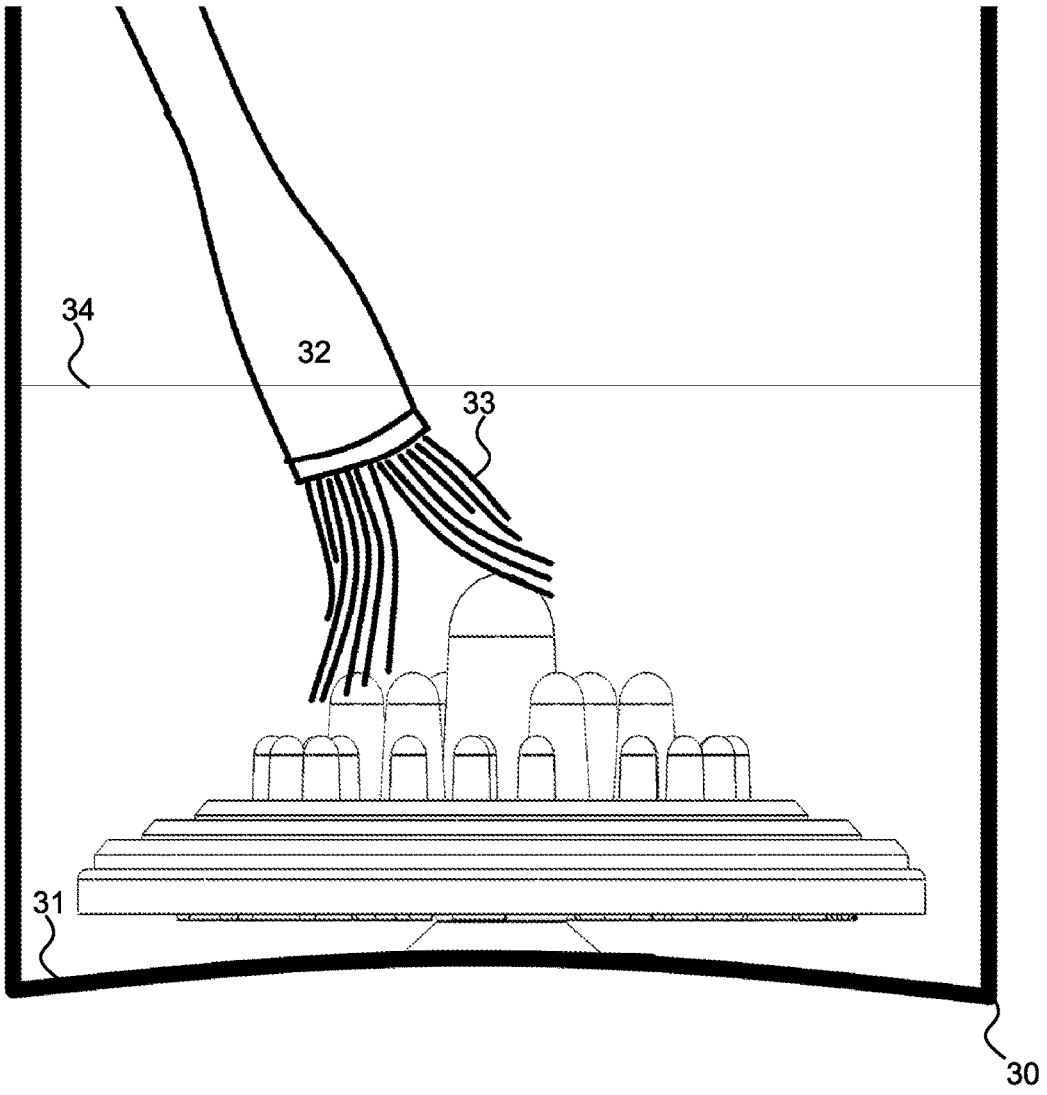
FIG. 6 is a view of a paint puck in use.

FIG. 6 is a view of a paint puck in use. The paint puck is fitted into a coffee cup 30 with its suction cup fitted to the bottom surface 31 of the cup. To enable fitting into and nearly filling most standard-size drinking cups such as coffee cups, the most common size of the paint puck will be less than or equal to 55 mm in diameter. For all sizes of paint puck, the paint puck will have a diameter of at least 90% the interior bottom diameter but less than 100% the interior bottom diameter of the paint washing cup for which it is meant, whether that paint washing vessel is a standard 8 oz, 16 oz, 32 oz or 64 oz disposable cup, respectively.

Because the paint puck will be nearly flush to the interior diameter of the cup in some instances, the paint puck material must be flexible enough to allow bending for removal from a cup. A paint puck that is flexible enough for removal from a cup into which it is fitted tightly will be referred to as having an enhanced paint puck removal commitment for the purposes of this application. In practical terms, a paint puck staging disk having a Shore (A) hardness of 55 or less is flexible enough to have an enhanced paint puck removal commitment.

To prevent extraneous wobbling and flexing of the paint puck by the user's paint brush, the suction cup 8 height must be limited. In the preferred embodiment, the suction cup has a height of no more than 15 mm unflexed.

A paint brush 32 with bristles 33 is shown to help illustrate use of the paint puck. A user fits a paint puck device into a paint washing cup and secures it to the interior bottom surface of the paint washing cup using the suction cup. The user will general fill the paint washing cup with a solvent liquid such as water or turpentine to a depth such that the surface of the solvent 34 is submerging the top of the paint puck or at least 20 mm.

Grasping a paintbrush having a handle and bristles by its handle, the bristles having been coated with paint in the act of painting, the user places the paintbrush into the paint cup such that its bristles enter the solvent liquid and touch the paint puck device. As the diagram illustrates, agitating the paintbrush in radial or circular motions scrapes and splits the mass of bristles against the paint puck teeth, removing and dispersing paint into the solvent.

As mentioned above, the paint puck must be constituted with plane reversion commitment such that it will not fold over on itself during use. FIG. 6 illustrates the importance of plane reversion commitment. If a paint brushes slides under the edge of a paint puck—possible given the raising of the paint puck by the suction cup and the variations of paint washing cup sizes—and lifts a staging disk edge, an improperly constituted device without plane reversion commitment could fold over and present its smooth bottom surface. The user would not see the folding occur through turbid solvent, and the smooth bottom surface would not work to scrape paint. The danger of disk folding is also increased because the disk of the paint puck is buoyed by solvent. Thus, inadvertent disk folding must be prevented by balancing staging disk thickness, tooth heights and paint puck material flexibility against the diameter of the staging disk such that the paint puck device exhibits plane reversion commitment.

After removing the paintbrush from the paint washing cup or otherwise finishing painting activities, the user of the paint puck disposes of his used solvent and removes the paint puck device from the paint washing cup. As mentioned above, the paint puck may be slippery with paint and solvent. To be amenable to removal from a tight fit, the paint puck must be pinchable or compressible and exhibit at least some basic puck removal commitment wherein the paint puck material durometer is Shore (A) 70 or less. Preferably, an enhanced paint puck removal commitment is exhibited via paint puck material durometer of Shore (A) 55 or less. The paint puck can then be cleaned using soap, water or solvents.

Although the present invention has been described in connection with certain specific embodiments for instructional purposes, the present invention is not limited thereto. Accordingly, various modifications, adaptations, and combinations of various features of the described embodiments can be practiced without departing from the scope of the invention.

What is claimed is:

1. A device for cleaning paint brushes, comprising:

a circular staging disk made of a flexible paint puck material having a durometer, said staging disk having an outer edge, a diameter, a radius, a thickness, a bottom surface and a top surface, said top surface having a center;

at least two sections of paint-cleaning teeth, comprising:

a first teeth-section, comprising a first number of paint-cleaning teeth made of a flexible paint puck material having a durometer, each paint-cleaning tooth of said first number having a height, said first number of paint-cleaning teeth having a first minimum tooth-height and a first maximum tooth-height, said first number being at least one;

a second teeth-section, comprising a second number of paint-cleaning teeth made of a flexible paint puck material having a durometer, each paint-cleaning tooth of said second number having a height, said second number of paint-cleaning teeth having a second minimum tooth-height and a second maximum tooth-height, said second number being an even number greater than one, said first minimum tooth-height being greater than said second maximum tooth-height said first teeth-section being disposed at the center of the top surface of the staging disk, said second teeth-section surrounding said first teeth-section in a circular fashion on the top surface of the staging disk; and, a flexible suction cup attached to the bottom surface of the staging disk, said suction cup having an upper attachment point being a portion of the flexible suction cup at which the flexible suction cup is permanently affixed to the bottom surface of the staging disk, said suction cup also having a lower cup rim and a height, said height being a distance from the upper attachment point to the lower cup rim; wherein said first number of paint-cleaning teeth comprises a beak, said beak being disposed at the center of the top surface of the staging disk, said beak having a height that is equal to the first maximum tooth-height.

2. The device of claim 1, said second teeth-section being concentric with said first teeth-section.

3. The device of claim 1, said device being fittable into the bottom of a standard-sized paint washing cup, said paint washing cup having an interior diameter, wherein said staging disk diameter is equal to or greater than 90% of said interior diameter and wherein said staging disk diameter is less than 100% of said interior diameter, and wherein said standard-sized paint washing cup is one of:

an 8 oz disposable cup, a 16 oz disposable cup, a 32 oz disposable cup, a 64 oz disposable cup, and a standard cylindrical coffee cup.

4. The device of claim 1, wherein said second number of paint-cleaning teeth has an aggressive radial barrier commitment.

5. The device of claim 1, wherein said second number of paint-cleaning teeth has a durometer of at least 25 as measured in Shore (A) hardness.

6. The device of claim 1, wherein said staging disk has an enhanced paint puck removal commitment.

7. The device of claim 1, wherein said staging disk has a durometer of no more than 55 as measured in Shore (A) hardness.

8. The device of claim 1, wherein said staging disk has a diameter of no more than 55 mm.

9. The device of claim 1, wherein the height of said suction cup is no greater than 15 mm.

10. The device of claim 1, wherein a combination of said first number of paint-cleaning teeth and said second number of paint-cleaning teeth comprises:

radial paint-cleaning barriers, and circular paint-cleaning barriers.

11. The device of claim 1 having a plane reversion commitment.

12. The device of claim 1, wherein the thickness of the staging disk plus the second minimum tooth-height is greater than one-twelfth the diameter of the staging disk.

13. The device of claim 1, wherein said paint-cleaning teeth are arranged in a lands and grooves pattern, wherein some of said paint-cleaning teeth are ledge-shaped, said ledge-shaped paint-cleaning teeth having outside corners and inside corners, wherein said outside corners are circular paint-cleaning barriers and wherein said inside corners are radial paint-cleaning barriers.

14. The device of claim 1, wherein said paint-cleaning teeth are arranged in a spiky teeth pattern, wherein some of said paint-cleaning teeth are spike-shaped, said spike-shaped paint-cleaning teeth having outside vertical edges and lateral vertical edges, wherein said outside vertical edges are radial paint-cleaning barriers and wherein said lateral vertical edges are circular paint-cleaning barriers.

15. The device of claim 1, wherein said beak has a height of at least 8 mm.

16. A device for cleaning paint brushes, comprising:

a circular staging disk made of a flexible paint puck material having a durometer, said staging disk having an outer edge, a diameter, a radius, a thickness, a bottom surface and a top surface, said top surface having a center;

at least two concentric sections of paint-cleaning teeth, comprising:

a first teeth-section, comprising a first number of paint-cleaning teeth made of a flexible paint puck material having a durometer, each paint-cleaning tooth of said first number having a height, said first number of paint-cleaning teeth having a first minimum tooth-height and a first maximum tooth-height, said first number being at least one;

a second teeth-section, comprising a second number of paint-cleaning teeth made of a flexible paint puck material having a durometer, each paint-cleaning tooth of said second number having a height, said second number of paint-cleaning teeth having a second minimum tooth-height and a second maximum tooth-height, said second number being an even number greater than one, said first minimum tooth-height being greater than said second maximum tooth-height said first teeth-section being disposed at the center of the top surface of the staging disk, said second teeth-section surrounding said first teeth-section in a circular fashion on the top surface of the staging disk; and, a flexible suction cup attached to the bottom surface of the staging disk, said suction cup having an upper attachment point being a portion of the flexible suction cup at which the flexible suction cup is permanently affixed to the bottom surface of the staging disk, said suction cup also having a lower cup rim and a height, said height being a distance from the upper attachment point to the lower cup rim;

wherein said first number of paint-cleaning teeth comprises a beak, said beak being disposed at the center of the top surface of the staging disk, said beak having a height that is equal to the first maximum tooth-height;

wherein said second number of paint-cleaning teeth has an aggressive radial barrier commitment;

wherein said staging disk has an enhanced paint puck removal commitment;

wherein said staging disk has a diameter of no more than 55 mm;

wherein the height of said suction cup is no greater than 15 mm;

wherein a combination of said first number of paint-cleaning teeth and said second number of paint-cleaning teeth comprises:

radial paint-cleaning barriers, and circular paint-cleaning barriers;

wherein the thickness of the staging disk added to the second minimum tooth-height is greater than one-twelfth the diameter of the staging disk;

wherein said beak has a height of at least 8 mm.

* * * * *